US005515836A

United States Patent [19]

Martin et al.

[11] Patent Number: 5,515,836

[45] Date of Patent: May 14, 1996

[54] TILLER ADJUSTMENT SYSTEM FOR AN ARCHERY BOW

[75] Inventors: Gail H. Martin; George T. Newbold, both of Walla Walla; Fredrick L. Hatfield, Yakima, all of Wash.; Thomas E. Coffman, Myrtle Point; James A. Lloyd, Coquille, both of Oreg.

[73] Assignee: Martin Archery, Inc., Walla Walla, Wash.

[21] Appl. No.: 336,276

[22] Filed: Nov. 8, 1994

[51] Int. Cl.[6] ..... F41B 5/00

[52] U.S. Cl. ..... 124/23.1; 124/88

[58] Field of Search ..... 124/23.1, 24.1, 124/25.6, 86, 88

[56] References Cited

U.S. PATENT DOCUMENTS

| | | | |
|---|---|---|---|
| 4,078,538 | 3/1978 | Shepley | 124/25.6 |
| 4,793,319 | 12/1988 | Vaughan et al. | 124/25.6 |
| 5,090,395 | 2/1992 | Gannon | 124/25.6 |
| 5,231,970 | 8/1993 | Ploot et al. | 124/23.1 |
| 5,339,790 | 8/1994 | Smith | 124/25.6 |
| 5,388,563 | 2/1995 | Hsu | 124/23.1 |
| 5,411,008 | 5/1995 | Hsu | 124/23.1 |

OTHER PUBLICATIONS

Yamaha Archery brochure, "Recurve Bows/Compound Bows", 1992, pp. 1, 6 and 7.

Hoyt USA brochure, "World Class Archery Products", 1993, 2 pages (unnumbered).

*Primary Examiner*—Eric K. Nicholson

*Assistant Examiner*—John A. Ricci

*Attorney, Agent, or Firm*—Wells, St. John, Roberts, Gregory & Matkin

[57] ABSTRACT

A tiller adjustment system for an archery bow includes a tiller adjustment knob for precisely adjusting the tiller of a bow limb. A locking mechanism secures the tiller adjustment knob in place to ensure that the precise tiller adjustments are not disturbed, even when the bow is broken down for travelling and storage. A specialized spacer with a curved top surface is disposed within a similarly curved ceiling of an internal cavity formed in the tiller adjustment knob. In addition, a biasing mechanism in the form of two spring steel members are positioned in the bottom of the limb pocket to urge the bow limb into engagement with the tiller adjustment knob.

18 Claims, 7 Drawing Sheets

TILLER ADJUSTMENT SYSTEM FOR AN ARCHERY BOW

TECHNICAL FIELD

This invention relates to archery bows, and more particularly to adjustment mechanisms for archery bows.

BACKGROUND OF THE INVENTION

To function properly, archery bows must be adjusted in a variety of ways. Archers each have unique characteristics (e.g., draw length, ability to pull a certain draw weight, etc.) which will change the way a bow launches an arrow. In addition, there are numerous variables relating to archery equipment (e.g., arrow size and weight, draw length, draw weight, and type of release used) that affect arrow flight. As a result, many different tuning adjustments to an archery bow are typically required to ensure proper arrow flight.

With respect to compound bows, various tuning adjustments may be made to improve arrow flight. For example, changing the nocking point, adjusting the location and tension of the arrow rest, increasing or decreasing the draw weight, and increasing or decreasing the arrow spine will all affect arrow flight. To change the hocking point of the arrow on the bowstring, the most common way to achieve such an adjustment is to physically change the location of the hock point that is secured to the bowstring.

It is also possible to adjust the hocking point by adjusting the tiller of one or both bow limbs. The tiller of a bow limb is the perpendicular distance between the bowstring and the limb. This distance is measured from the bowstring at a perpendicular point where the bow limb attaches to the handle riser to the string. Therefore, the tiller of each limb can be separately measured and adjusted. On a compound bow, this is typically accomplished by adjusting the limb bolts.

A few recent efforts have recently been made to provide devices for adjusting the tiller of a recurve bow. Traditionally, there was no way to adjust the tiller of a traditional recurve bow because the limbs and handle riser were made of a single, integral piece of material.

Only a few adjustments can be made to a recurve bow for tuning purposes. After the center shot of the arrow has been set, the only adjustment to be made is the location of the nocking point. There are no pulleys or cams to adjust for and the draw weight is typically unchangeable. The nocking point can be changed either by physically changing the location of the nock point on the bowstring, or alternatively by changing the tiller of one or both limbs.

For high performance archers, fine tuning of the nocking point is required. Physically changing the location of the nock point on the bow string in small increments is very difficult, since it requires uncrimping and recrimping of the nock point. Precision in such a process is not achievable. Therefore, precision adjustments to the nocking location of a recurve bow requires a tiller adjustment.

A particular advantage of some recurve bows is that they can be broken down for storage and traveling purposes. A major drawback, however, with respect to recurve bows with tiller adjustment capabilities is that in order to break down the recurve bow, the tiller adjustments must be undone. Thus, the tiller adjustments would have to be recreated each time the bow is reassembled for shooting. Because several hours of shooting are required to fine tune the tiller adjustments for recurve bows, the same precision adjustments cannot be made in time when an archer is traveling to a tournament or to a hunting area.

Accordingly, there is a need to provide a device that enables accurate and precision tiller adjustments for tuning a bow. In addition, there is a need to provide a device that secures and maintains precision tiller adjustments for recurve bows for take-down recurve bows so that the adjustments do not have to be replicated when travelling.

The present invention involves a tiller adjustment system for archery bows, particularly recurve archery bows. The tiller adjustment system allows incremental, precise tiller adjustments to be made to each bow limb. In addition, the tiller adjustment system includes a locking mechanism that allows a recurve bow to be taken down and reassembled while maintaining precisely the tiller adjustments previously made to the recurve bow. Other features, advantages, and objects of the invention will become more apparent from the detailed disclosure that follows.

BRIEF DESCRIPTION OF THE DRAWINGS

Preferred embodiments of the invention are described below with reference to the accompanying drawings, which are briefly described below.

FIG. 4 is a sectional side elevation view, taken along the line 4—4 of FIG. 2, of the tiller adjustment system according to the present invention;

FIG. 9 is a section side elevation view of the tiller adjustment system of the present invention.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

A tiller adjustment system for an archery bow characterized by:

a limb pocket for receiving a bow limb and anchoring the bow limb to a handle riser of an archery bow, the limb pocket having a central portion;

a limb bolt coupled to the central portion of the limb pocket;

a tiller adjustment knob coupled to the limb bolt, the tiller adjustment knob being engageable with a bow limb for making tiller adjustments to the limb; and a lock coupled to the tiller adjustment knob to lock the tiller adjustment knob in place relative to the limb bolt to maintain a bow limb at a particular tiller.

Figure 1:
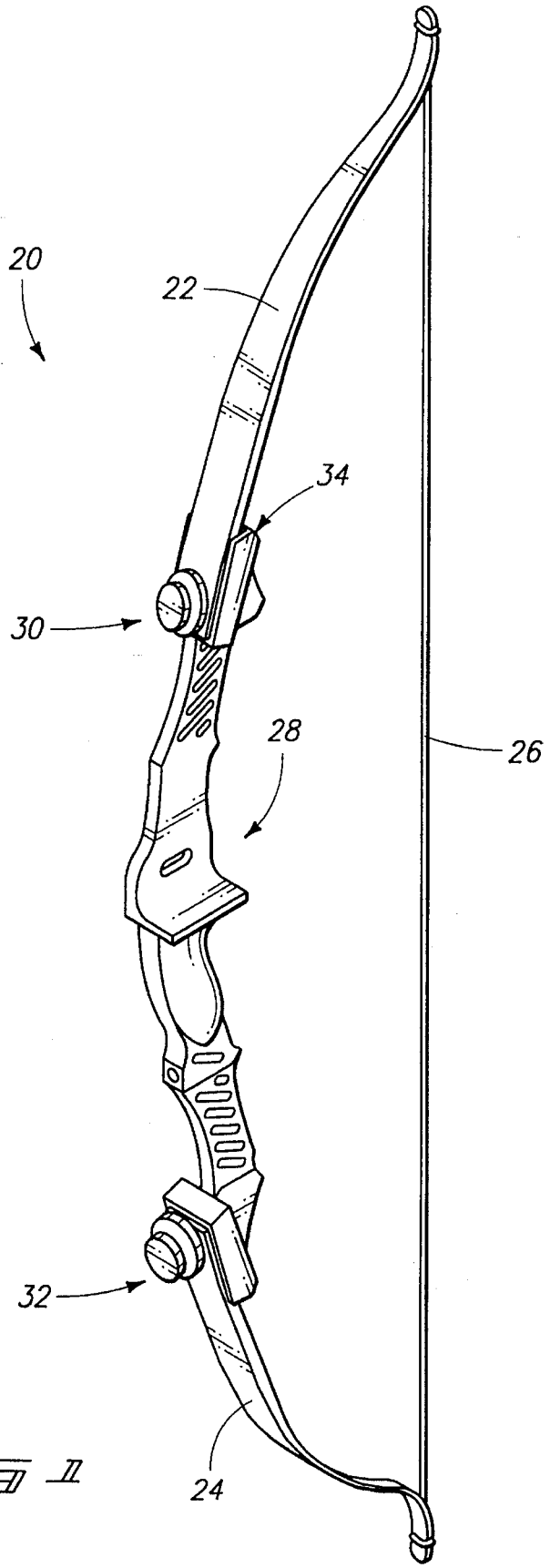
FIG. 1 is an isometric view of an archery bow incorporating the tiller adjustment system of the present invention.
Figure 2:
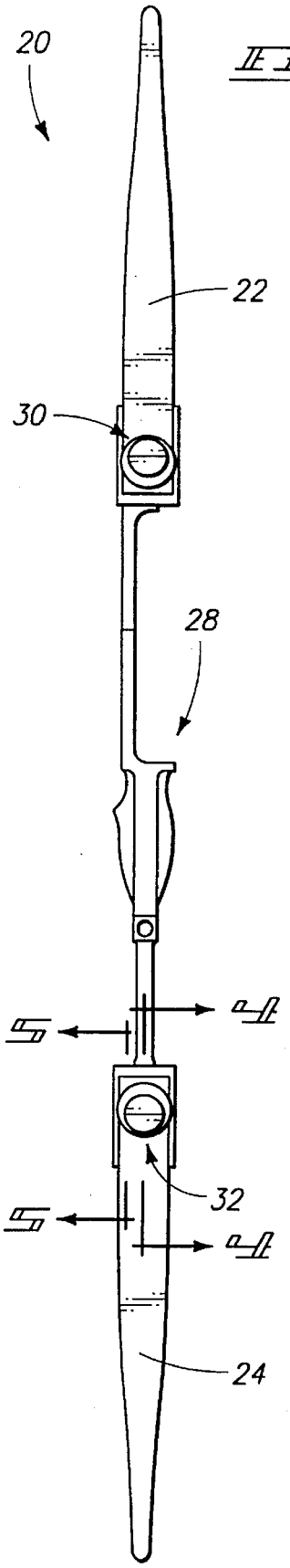
FIG. 2 is a front view of an archery bow including a tiller adjustment system of the present invention.
Figure 3:
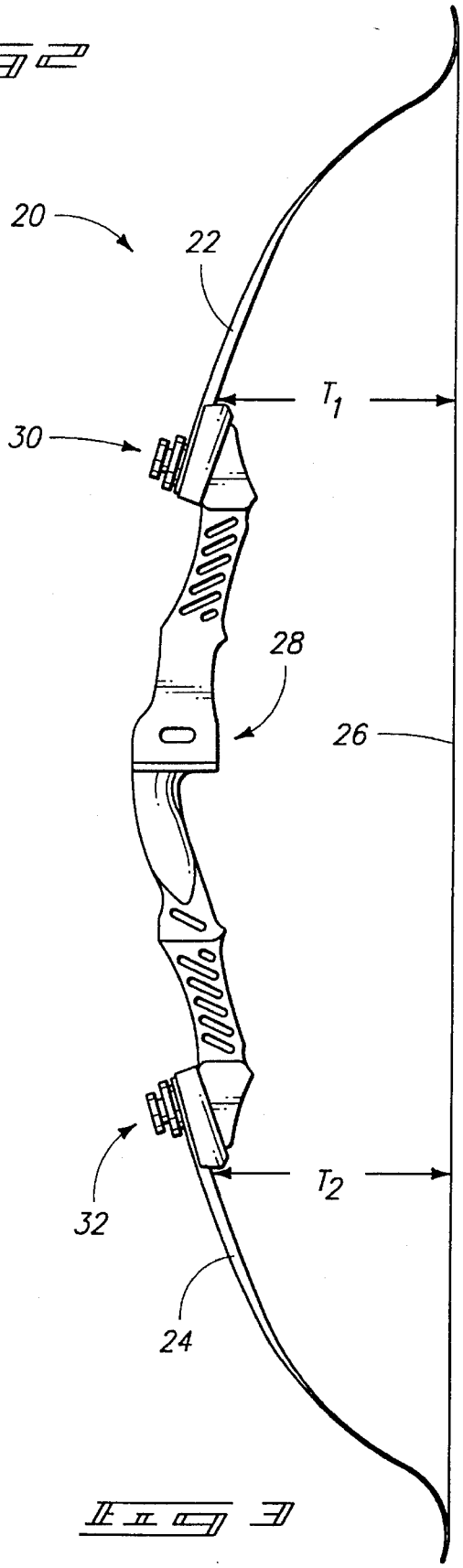
FIG. 3 is a side elevation view of an archery bow incorporating the tiller adjustment system of the present invention.
Figure 3:
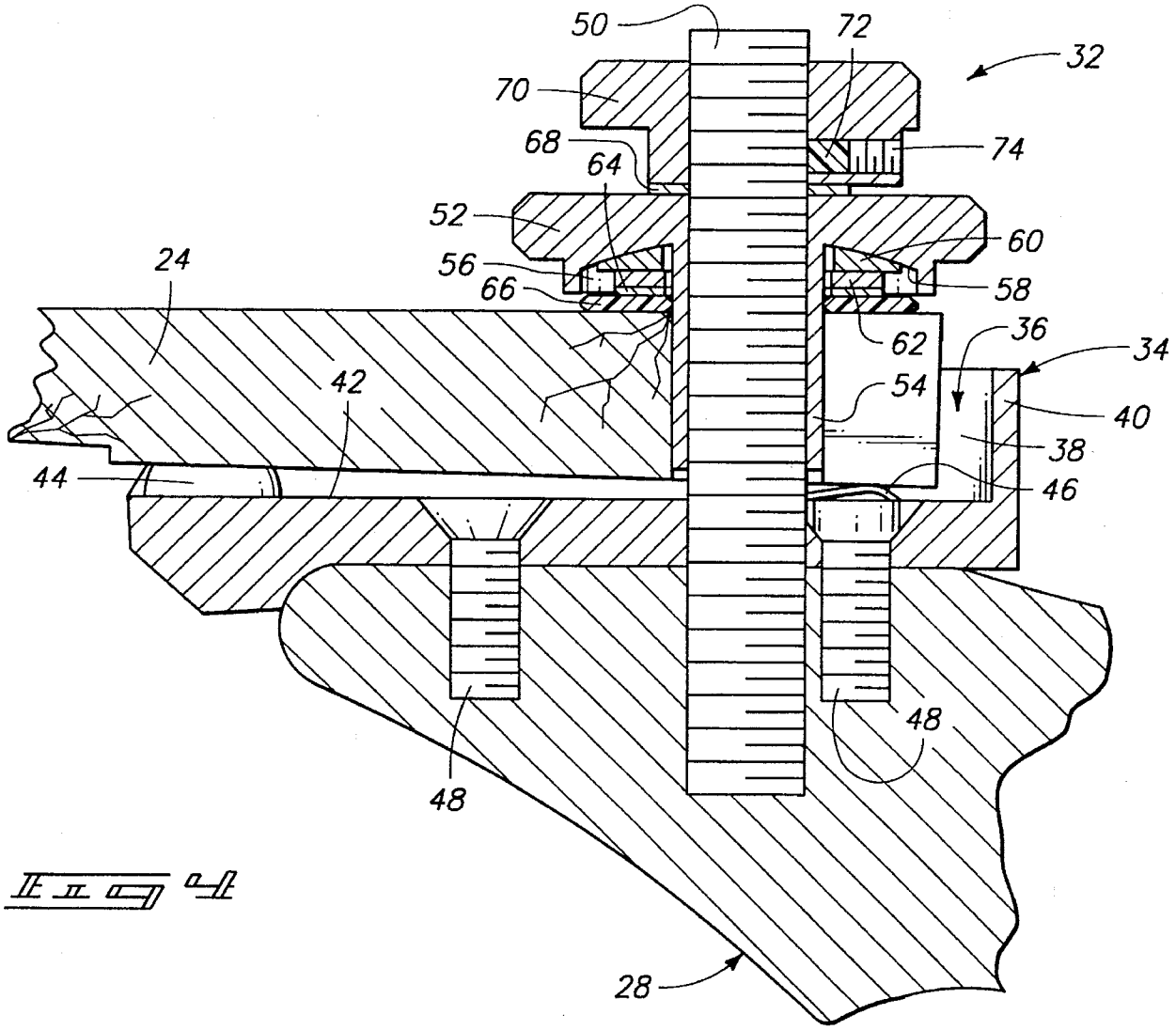

FIG. 1 shows an archery bow 20 having an upper limb 22 and a lower limb 24. A bowstring 26 is coupled between the upper limb 22 and lower limb 24. Upon installing the bowstring onto the bow as shown in FIG. 1, a tiller measurement (i.e., the perpendicular distance between the bowstring and each limb where the respective limb meets the limb pocket) can be made for each limb. FIG. 3 shows the proper locations at which the tiller measurements T1 and T2 are made.

The upper bow limb 22 and the lower bow limb 24 are attached to a handle riser 28. An upper limb tiller adjustment assembly 30 and a lower limb tiller adjustment assembly 32 are attached to upper and lower limbs, respectively. The tiller measurements T1 and T2 are adjusted by means of the tiller adjustment assemblies to change the location of the respective bow limbs relative to the bow string.

Figure 5:
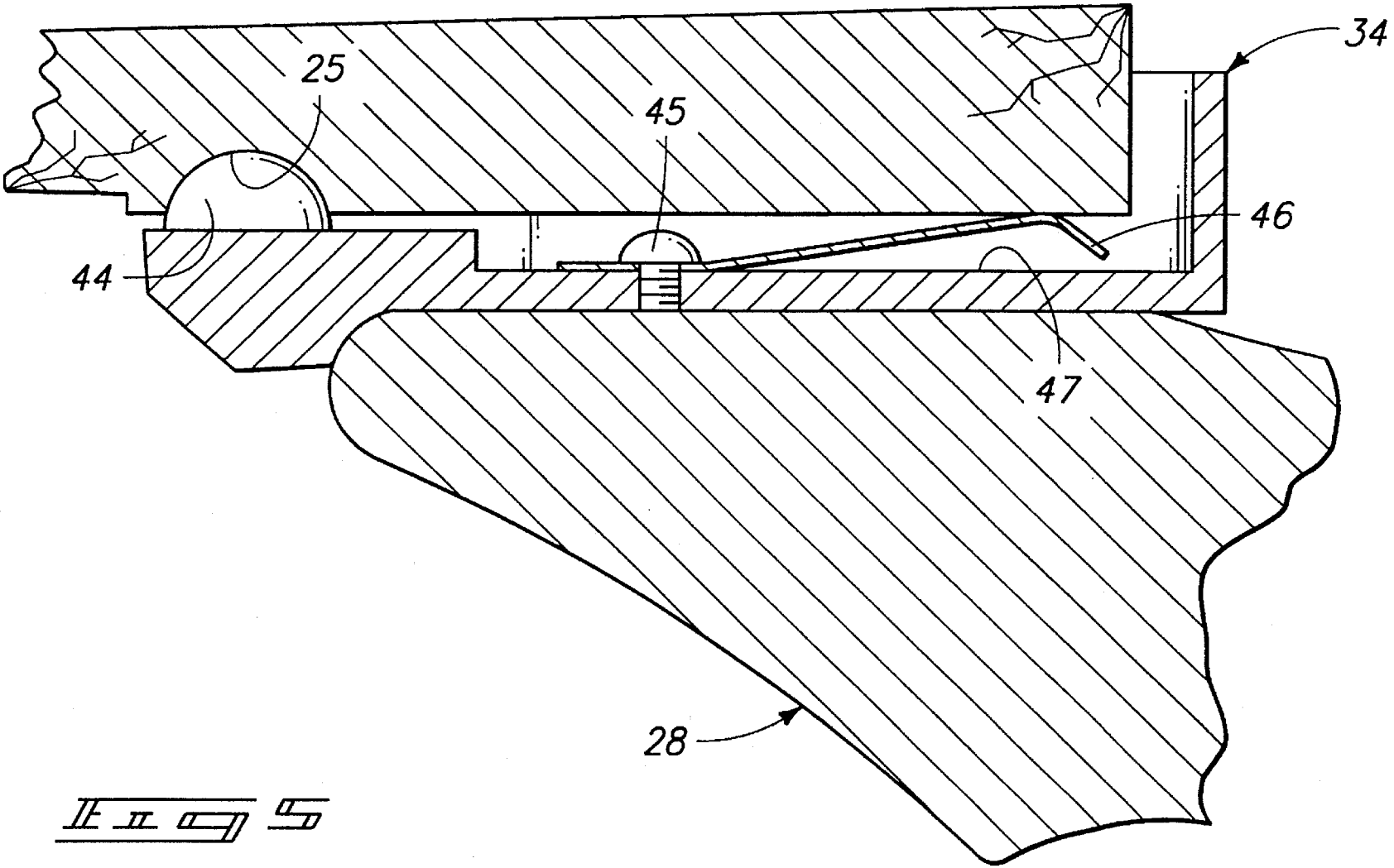
FIG. 5 is a section side elevation view, taken along the line 5—5 of FIG. 2, of the tiller adjustment system of the present invention.
Figure 6:
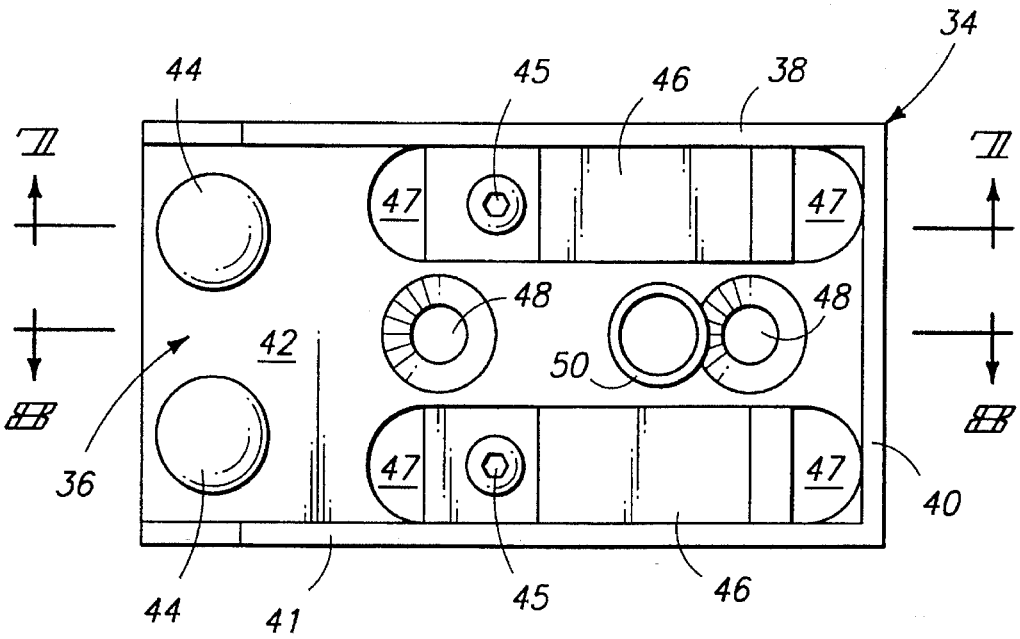
FIG. 6 is a top view of a limb pocket utilized in conjunction with the present invention.
Figure 7:
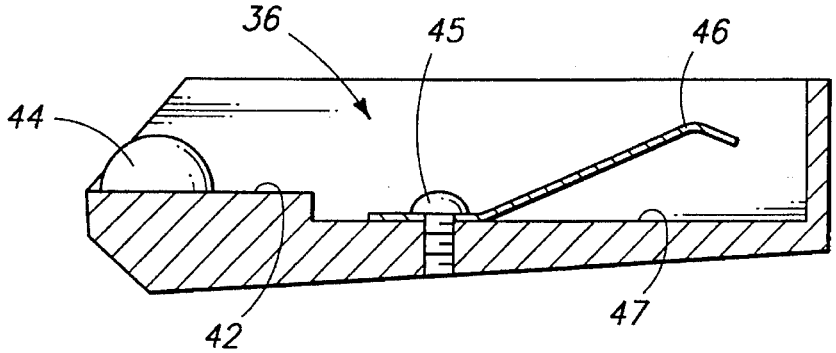
FIG. 7 is a sectional side elevation view, taken along the line 7—7 of FIG. 6, of the limb pocket.
Figure 8:
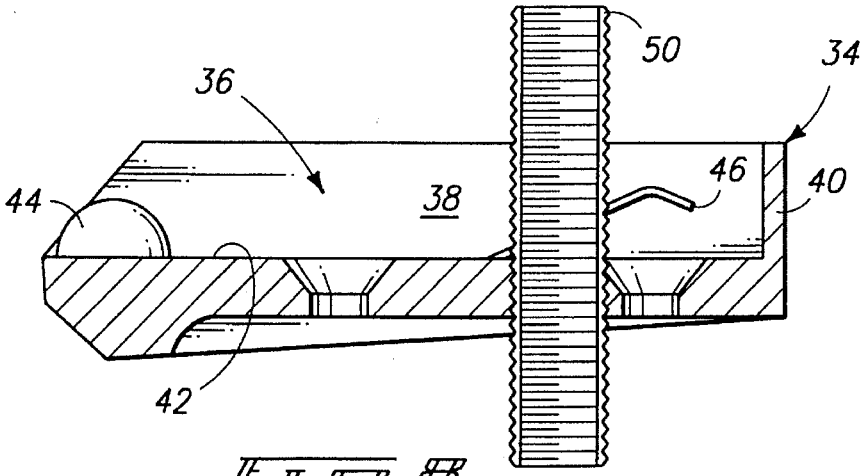
FIG. 8 is a sectional side elevation view, taken along the line 8—8 of FIG. 6, of the limb pocket according to the present invention.
Figure 6:
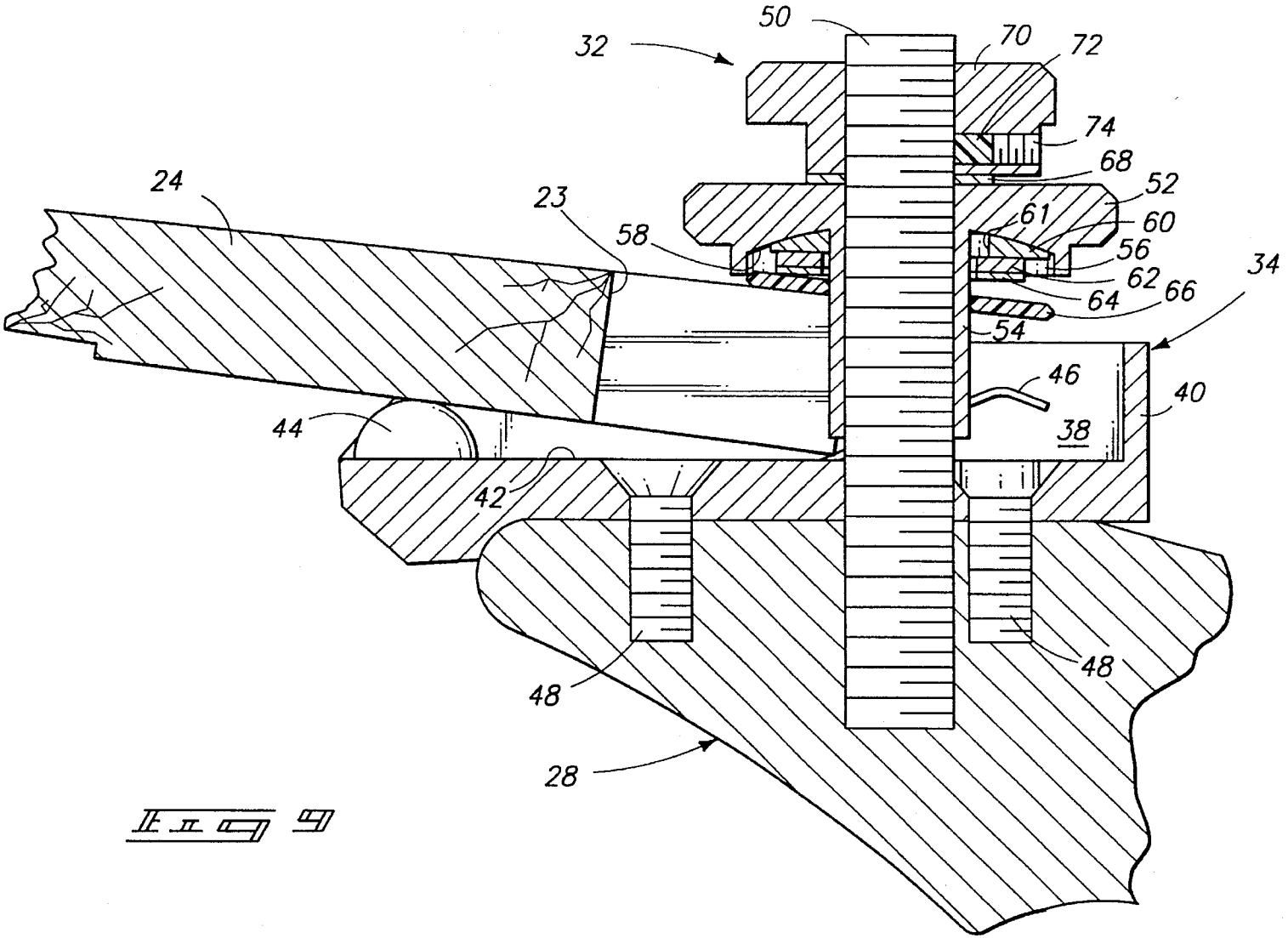
Figures 10, 11:
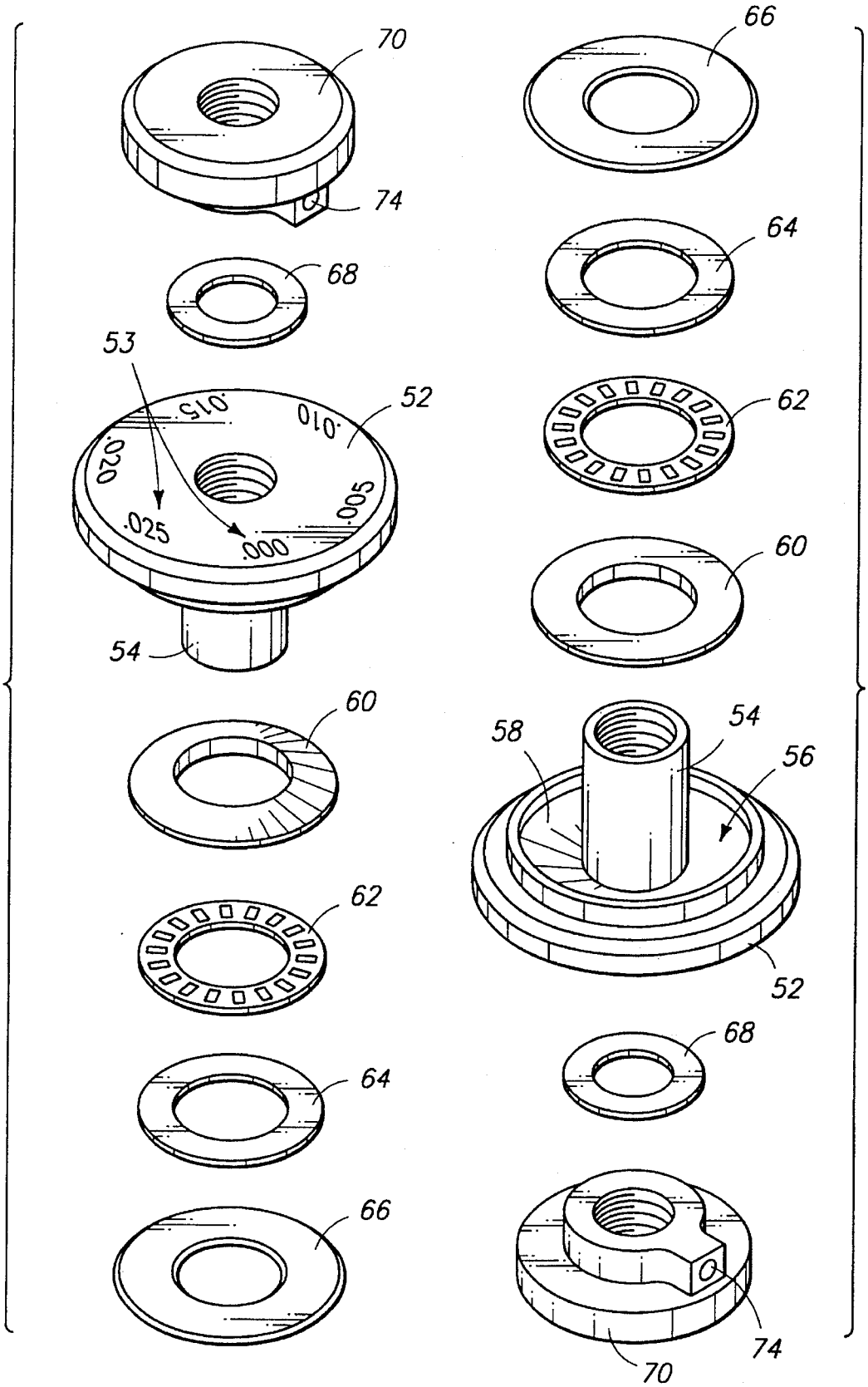
FIGS. 10 and 11 are exploded isometric views of the tiller adjustment system according to the present invention.

FIGS. 4 and 5 show the details of the tiller adjustment system and interconnection between the limb 24 and the handle riser 28. A limb pocket 34 includes a channel area 36, a first sidewall 38, an end wall 40, a second sidewall 41, and a bottom wall 42. A bow limb 24 is intended to be inserted into the channel 36 of the limb pocket 34. A pair of spring steel biasing arms 46 are attached to respective wells 47 formed in the bottom wall 42 of the limb pocket 34. The biasing arms 46 are attached to the bottom wall by means of respective fasteners 45. The bottom wall itself is secured to the handle riser by means of fasteners 48 (FIG. 4).

A limb bolt 50 is threadably received by the handle riser 28 and the limb pocket 34. The limb bolt 50 extends through a central portion of the limb pocket 34. The limb bolt 50 is the structure to which the tiller adjustment system is attached.

An adjustment means in the form of a tiller adjustment knob 52 is threadably inserted over the limb bolt 50. The tiller adjustment knob includes a sleeve portion 54 which extends over the limb bolt to protect the bolt from contact with the limb 24 when inserted into the limb pocket 34 (as shown in FIG. 4). A plurality of written indicia 53 are provided to allow precise, predetermined adjustments to be made to the tiller of each limb. The indicia preferably provide information concerning the amount of change in tiller according to the degree to which the adjustment knob is rotated.

A U-shaped slot is provided in the limb in order to insert the bow limb in an encircling manner around the sleeve 54 of the tiller adjustment knob 52.

An internal cavity 56 is formed underneath the tiller adjustment knob 52. The cavity is formed in part by a partially spherical ceiling 58. A spacer 60 having a top curved surface is inserted over the sleeve 54 and a limb bolt 50 to engage the ceiling 58. Below the spacer is a bearing 62 which also is disposed around the sleeve 54 of the adjustment knob 52. A metal washer 64 is positioned below the bearing 62, and a plastic washer 66 is positioned against the limb for engaging the top surface of the bow limb to prevent damage thereto. On the other end of the tiller adjustment assembly, a washer 68 is positioned over the limb bolt 50, after which a locking nut 70 is threadably received by the limb bolt 50. The lock nut is used to engage the tiller adjustment knob 52 to prevent relative rotation therebetween. The locking nut is secured in place relative to the limb bolt 50 by means of a set screw 74. A plastic piece 72 may be inserted between the set screw 74 and the limb bolt 50 to prevent damage to the threads of the limb bolt from tightening the set screw 74.

When installing a limb into the tiller adjustment assembly, a free end of the limb is inserted over the rocker buttons 44 and around the combined sleeve 54 and limb bolt 50. In order to allow the limb to be inserted in this manner, so that the tiller adjustments remain constant, compensation must be made for the angle of the bow limb as it is inserted into the limb pocket 34 so that damage is not done to the limbs. With reference to FIG. 9, when the limb 24 is first inserted into the limb pocket 34, a limb slot 23 is positioned to straddle the combined sleeve 54 and limb bolt. When the limb is first being inserted, the synthetic washer 66 is urged and inclines relative to the horizontal to accommodate insertion of the limb. This causes the spacer 60 to slide relative to the ceiling surface 58 to likewise accommodate insertion of the limb at an inclined angle. As such, the limb 24 is able to slide into the limb pocket 34 without binding with or being damaged by the adjustment bolt 52. When the limb 24 is being inserted, the biasing force of spring steel members 46 is overcome and the rocker buttons 44 settle into dished-out areas in the limb (not shown). After the limb has been completely installed, as shown in FIG. 4, the spring steel bias members 46 urge the limb into engagement with the tiller adjustment knob through the various spacers and washers as shown.

Accordingly, a primary advantage of the present invention is that adjustments to the tiller of each bow limb can be made with precision to properly tune the bow. Thereafter, the bow can be broken down for storage and travelling without the need to undo the tiller adjustments. The bow can then later be reassembled so that the previous tiller adjustments will remain the same. The present invention also enables fine tuning to be accomplished by means of the tiller adjustment knob 52 after which the locking knob 70 secures the tiller adjustment means in place relative to the limb bolt 50. The limb is thereafter removed by overcoming the spring force of spring steel members 46 and urging the spacer to move relative to the arced or arched surface of the ceiling 58.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

We claim:

1. A tiller adjustment system for an archery bow, comprising:

a limb pocket for receiving a bow limb and anchoring the bow limb to a handle riser of an archery bow, the limb pocket having a central portion;

a limb bolt coupled to the central portion of the limb pocket;

a tiller adjustment knob threadably received by the limb bolt, the tiller adjustment knob being engageable with a bow limb for making tiller adjustments to the limb; and a lock coupled to the tiller adjustment knob to lock the tiller adjustment knob in place relative to the limb bolt to maintain a bow limb at a particular tiller.

2. A tiller adjustment system according to claim 1, further comprising indicia on a top surface of the adjustment knob, the indicia corresponding to an amount of change in the tiller measurement according to the degree of rotation of the tiller adjustment knob.

3. A tiller adjustment system for an archery bow, comprising:

a limb pocket for receiving a bow limb and anchoring the bow limb to a handle riser of an archery bow, the limb pocket having a central portion;

a limb bolt coupled to the central portion of the limb pocket;

a tiller adjustment knob coupled to the limb bolt, the tiller adjustment knob being engageable with a bow limb for making tiller adjustments to the limb;

a lock coupled to the tiller adjustment knob to lock the tiller adjustment knob in place relative to the limb bolt to maintain a bow limb at a particular tiller; and wherein the lock comprises a locking nut threadably received by the limb bolt, the locking nut rotatably engaging the tiller adjustment knob to prevent relative movement between the tiller adjustment knob and the locking nut.

4. A tiller adjustment system according to claim 3, further comprising a set screw threadably received by the locking nut to lock the tiller adjustment knob in place relative to the limb bolt.

5. A tiller adjustment system for an archery bow, comprising:

a limb pocket for receiving a bow limb and anchoring the bow limb to a handle riser of an archery bow, the limb pocket having a central portion;

a limb bolt coupled to the central portion of the limb pocket;

a tiller adjustment knob coupled to the limb bolt, the tiller adjustment knob being engageable with a bow limb for making tiller adjustments to the limb;

a lock coupled to the tiller adjustment knob to lock the tiller adjustment knob in place relative to the limb bolt to maintain a bow limb at a particular tiller; and further comprising:

a spacer having an arced surface and a flat surface, the flat surface being engageable with a surface of a bow limb;

an internal cavity formed underneath the tiller adjustment knob, the internal cavity having a partially spherical ceiling for engagement with the arced surface of the spacer;

wherein the spacer moves relative to the spherical ceiling to allow a bow limb to be inserted into the limb pocket without moving the tiller adjustment knob.

6. A tiller adjustment system according to claim 5, further comprising:

a bias member coupled to a bottom surface of the limb pocket to bias a limb towards engagement with the flat surface of the spacer.

7. A tiller adjustment system according to claim 5, further comprising:

a bearing positioned between the spacer and the top surface of the limb to enable relative movement between the spacer and a bow limb.

8. A tiller adjustment system for an archery bow, comprising:

a limb pocket for receiving a bow limb and anchoring the bow limb to a handle riser of an archery bow, the limb pocket having a central portion;

a limb bolt coupled to the central portion of the limb pocket;

a tiller adjustment knob coupled to the limb bolt, the tiller adjustment knob being engageable with a bow limb for making tiller adjustments to the limb;

a lock coupled to the tiller adjustment knob to lock the tiller adjustment knob in place relative to the limb bolt to maintain a bow limb at a particular tiller; and further comprising a bias member mounted inside the limb pocket to bias a bow limb toward engagement with the tiller adjustment knob.

9. A tiller adjustment system for an archery bow, comprising:

a limb pocket for receiving a bow limb and anchoring the bow limb to a handle riser of an archery bow, the limb pocket having a central portion;

a limb bolt coupled to the central portion of the limb pocket;

a tiller adjustment knob coupled to the limb bolt, the tiller adjustment knob being engageable with a bow limb for making tiller adjustments to the limb;

a lock coupled to the tiller adjustment knob to lock the tiller adjustment knob in place relative to the limb bolt to maintain a bow limb at a particular tiller; and wherein the tiller adjustment knob includes a sleeve portion extending over and covering the limb bolt to protect the limb bolt from damage when the limb is inserted into the limb pocket.

10. A tiller adjustment system for an archery bow, comprising:

a limb pocket for receiving a bow limb and anchoring the bow limb to a handle riser of an archery bow, the limb pocket having a central portion;

a limb bolt coupled to the central portion of the limb pocket;

adjustment means threadably received by the limb bolt for making a tiller adjustment to a bow limb held within the limb pocket; and locking means operatively interconnected to the adjustment means for fixing the position of the adjustment means relative to the limb bolt to maintain a bow limb held by the limb pocket at a particular tiller.

11. A tiller adjustment system according to claim 10, further comprising indicia on a top surface of the adjustment means, the indicia corresponding to an amount of change in tiller according to an amount of movement of the adjustment means.

12. A tiller adjustment system for an archery bow, comprising:

a limb pocket for receiving a bow limb and anchoring the bow limb to a handle riser of an archery bow, the limb pocket having a central portion;

a limb bolt coupled to the central portion of the limb pocket;

adjustment means coupled to the limb bolt for making a tiller adjustment to a bow limb held within the limb pocket;

locking means operatively interconnected to the adjustment means for fixing the position of the adjustment means relative to the limb bolt to maintain a bow limb held by the limb pocket at a particular tiller; and wherein the locking means comprises a locking nut threadably received by the limb bolt, the locking nut rotatably engaging the adjustment means to prevent relative movement between the adjustment means and the locking nut.

13. A tiller adjustment system according to claim 12, further comprising a set screw threadably received by the locking means to secure the adjustment means in place relative to the limb bolt.

14. A tiller adjustment system for an archery bow, comprising:

a limb pocket for receiving a bow limb and anchoring the bow limb to a handle riser of an archery bow, the limb pocket having a central portion;

a limb bolt coupled to the central portion of the limb pocket;

adjustment means coupled to the limb bolt for making a tiller adjustment to a bow limb held within the limb pocket;

locking means operatively interconnected to the adjustment means for fixing the position of the adjustment means relative to the limb bolt to maintain a bow limb held by the limb pocket at a particular tiller; and further comprising:

a spacer having an arced surface and a flat surface, the flat surface being engageable with a surface of a bow limb;

an internal cavity formed in the adjustment means, the internal cavity having a partially spherical ceiling for engagement with the arced surface of the spacer;

wherein the spacer moves relative to the spherical ceiling to allow a bow limb to be inserted into the limb pocket without altering the adjustment means.

15. A tiller adjustment system according to claim 14, further comprising:

a bias member coupled to a bottom surface of the limb pocket to urge a limb held within the limb pocket into engagement with the fiat surface of the spacer.

16. A tiller adjustment system according to claim 14, further comprising:

a bearing positioned between the spacer and the top surface of a bow limb to enable relative movement between the spacer and a bow limb.

17. A tiller adjustment system for an archery bow, comprising:

a limb pocket for receiving a bow limb and anchoring the bow limb to a handle riser of an archery bow, the limb pocket having a central portion;

a limb bolt coupled to the central portion of the limb pocket;

adjustment means coupled to the limb bolt for making a tiller adjustment to a bow limb held within the limb pocket;

locking means operatively interconnected to the adjustment means for fixing the position of the adjustment means relative to the limb bolt to maintain a bow limb held by the limb pocket at a particular tiller; and further comprising a bias member mounted inside the limb pocket to urge a bow limb held within the limb pocket into engagement with the adjustment means.

18. A tiller adjustment system for an archery bow, comprising:

a limb pocket for receiving a bow limb and anchoring the bow limb to a handle riser of an archery bow, the limb pocket having a central portion;

a limb bolt coupled to the central portion of the limb pocket;

adjustment means coupled to the limb bolt for making a tiller adjustment to a bow limb held within the limb pocket;

locking means operatively interconnected to the adjustment means for fixing the position of the adjustment means relative to the limb bolt to maintain a bow limb held by the limb pocket at a particular tiller; and wherein the adjustment means includes a sleeve portion extending over and covering the limb bolt to protect the limb bolt from damage upon insertion of the limb.

* * * * *